US005154315A

United States Patent [19]

Dominico et al.

[11] Patent Number: 5,154,315

[45] Date of Patent: Oct. 13, 1992

[54] LID LOADING AND CONVEYING ASSEMBLY

[75] Inventors: James Dominico, West Paterson; Semyon M. Itskovich, Fair Lawn, both of N.J.

[73] Assignee: Van Dam Machine Corporation, West Paterson, N.J.

[21] Appl. No.: 721,171

[22] Filed: Jun. 26, 1991

[51] Int. Cl.[5] ..... B65G 59/00

[52] U.S. Cl. ..... 221/11; 221/105; 414/795.8

[58] Field of Search ..... 221/11, 104, 105, 108, 221/6; 414/795 B

[56] References Cited

U.S. PATENT DOCUMENTS

| | | | |
|---|---|---|---|
| 2,325,165 | 7/1943 | Goodwin | 221/104 |
| 3,506,156 | 4/1970 | Hanson et al. | 221/11 |
| 3,520,444 | 7/1970 | Manzer et al. | 221/11 |
| 3,621,828 | 11/1971 | Hansen | 221/11 |
| 3,688,946 | 9/1972 | Graham | 221/11 |
| 4,000,709 | 1/1977 | Mojden | 221/11 |
| 4,351,452 | 9/1982 | Scalera et al. | 221/103 |
| 4,558,802 | 12/1985 | Molison | 221/11 |
| 4,618,073 | 10/1986 | Bartfield et al. | 221/11 |

*Primary Examiner*—H. Grant Skaggs
*Attorney, Agent, or Firm*—Klauber & Jackson

[57] ABSTRACT

A lid loading and conveying assembly includes a carousel having an indexing plate with a plurality of pairs of tubes connected therearound for holding a plurality of stacks of lids therein; a rotatable support for rotationally supporting the carousel plate so that the stacks of lids can be sequentially indexed to a removal position; a plurality of spin rods for holding at least one stack of lids removed from the carousel tubes; an optical sensor which senses when the amount of lids on the spin rods is below a predetermined level; and a pusher assembly for conveying a stack of lids from the tubes at the removal position to the spin rods in response to the optical sesnor, the pusher assembly including a constrainment assembly at opposite ends of each stack of lids at the removal position for holding the stack of lids together as a unit in a slightly compressed form during the pushing operation from the carousel tubes to the spin rods, the constrainment assembly including an actuable gate at the lower end of the stacks of lids at the removal position and a pusher mechanism at the upper ends of the stacks of lids at the removal position, for pushing against the lids so as to constrain the lids between the pusher mechanism and the gate in the slighly compressed form, and a movement assembly for moving the gate and pusher mechanism together in order to move the stacks of lids as a unit in at most a slightly compressed form during the pushing operation from the carousel tubes to the spin rods.

24 Claims, 8 Drawing Sheets

LID LOADING AND CONVEYING ASSEMBLY

BACKGROUND OF THE INVENTION

The present invention relates generally to a lid feeding assembly and, more particularly, is directed to a lid loading and conveying assembly having a carousel with a plurality of stacks of lids loaded therein.

With a known conventional lid loading assembly, three horizontally oriented spin rods are positioned in spaced, parallel relation upstream of a vacuum pick and place assembly. Two parallel rows of horizontally oriented lids are placed on the spin rods upstream of the chain feeder and are transferred thereby, one at a time, onto a feed table to be picked up by a flight bar. With each row or stack of lids positioned on two spin rods, the lids are constantly moving towards the vacuum pick and place assembly by rotation of the spin rods.

However, with such assembly, it is necessary for a worker to continuously replenish the lids on the horizontally oriented spin rods. This results in wasted time and effort, where the worker cannot be performing other tasks.

Various devices provide a turret or the like for containing a plurality of stacks of lids. For example, U.S. Pat. No. 2,325,165 to Goodwin discloses a sensing mechanism for determining when the turret should be rotated for dispensing of the stack thereof. However, the stacks fall by means of gravity. Specifically, rotation of the turret continues until a tube containing a supply of caps or lids is brought into registration with a supply chamber. When this occurs, the stack of lids in the tube slides downwardly into the supply chamber. A sensor determines when the supply of lids in the supply chamber is exhausted, after which the operation continues by which the turret is again incrementally rotated to deposit the next stack of lids in the supply chamber. However, a problem with such assembly is that the lids may become disengaged from each other during their descent, which may cause misalignment, misregistration or the like of the lids in the supply chamber.

U.S. Pat. No. 4,558,802 to Molison discloses a carousel-type dispenser for dispensing a number of caps or lids. However, the stacks of lids are vertically oriented and when the carousel is rotated to the delivery chute, a mechanism is provided in order to drop one lid at a time by means of gravity.

U.S. Pat. No. 4,351,452 to Scalera et al. relates to a cup dispensing and delivery device using a turret feeder. However, the cups merely fall by gravity, either as a stack or one at a time, and therefore, this device suffers from the same deficiencies as Goodwin and Molison. See also U.S. Pat. Nos. 3,506,156 to Hanson et al. and 3,520,444 to Manzer et al.

U.S. Pat. No. 3,621,828 to Hansen discloses a target projecting device with a clay pigeon dispenser that uses a turret feeder. Again, the clay pigeons fall by means of gravity only.

OBJECTS AND SUMMARY OF THE INVENTION

Accordingly, it is an object of the present invention to provide a lid loading and conveying assembly that overcomes the aforementioned advantages with the prior art.

It is another object of the present invention to provide a lid loading and conveying assembly in which a plurality of stacks of lids are loaded on a carousel which sequentially delivers each stack for loading and conveying.

It is still another object of the present invention to provide a lid loading and conveying assembly in which each stack of lids is compressed to retain the lids in a stacked orientation during unloading from the carousel assembly.

In accordance with an aspect of the present invention, a lid loading and conveying assembly includes carousel means for holding a plurality of stacks of lids; rotatable support means for rotationally supporting the carousel means so that the stacks of lids can be sequentially moved to a removal position; track means for holding a stack of the lids removed from the carousel means; sensor means for sensing when the number of lids on the track means is below a predetermined level; and pusher means for pushing a stack of lids from the carousel means at the removal position to the track means in response to the sensor means, the pusher means including constrainment means at opposite ends of the stack of lids for holding the stack of lids together as a unit in a slightly compressed form during the pushing operation from the carousel means to the track means.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
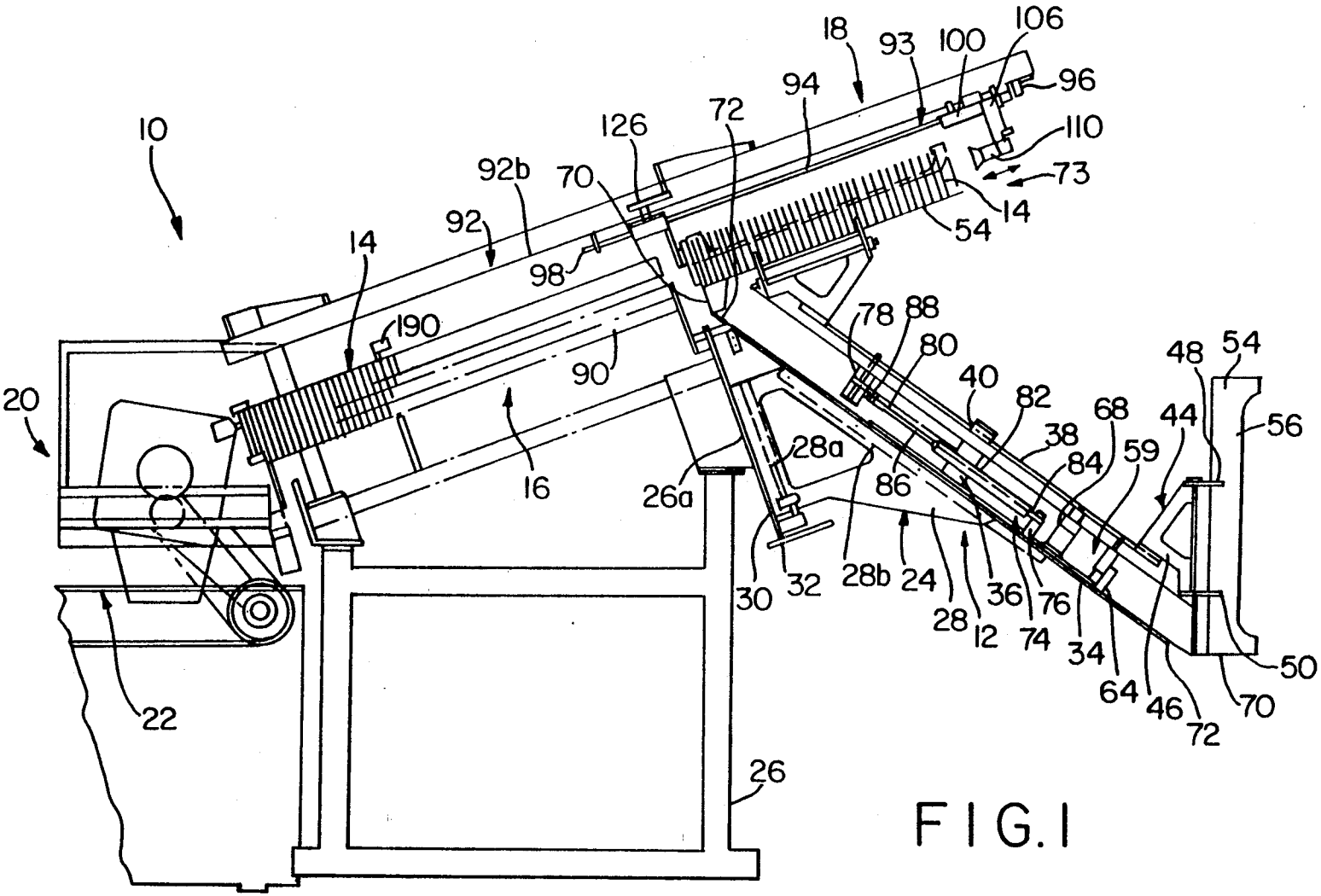
FIG. 1 is a side elevational view of a lid loading and conveying assembly according to the present invention.

Referring to the drawings in detail, and initially to FIG. 1 thereof, a lid loading and conveying assembly 10 according to the present invention includes a carousel assembly 12 for holding a plurality of stacks of lids 14, a spin rod assembly 16 for sequentially receiving at least one stack of lids 14 from carousel assembly 12 and a pusher assembly 18 for pushing a stack of lids 14 from carousel assembly 12 while constraining opposite ends of the stack as a unit in a slightly compressed form during the pushing operation. Lids 14 on spin rod assembly 16 are removed one at a time at the leading edge thereof by a vacuum pick and place assembly 20, and placed on a printer table 22 for subsequent operations downstream therefrom.

Figure 2:
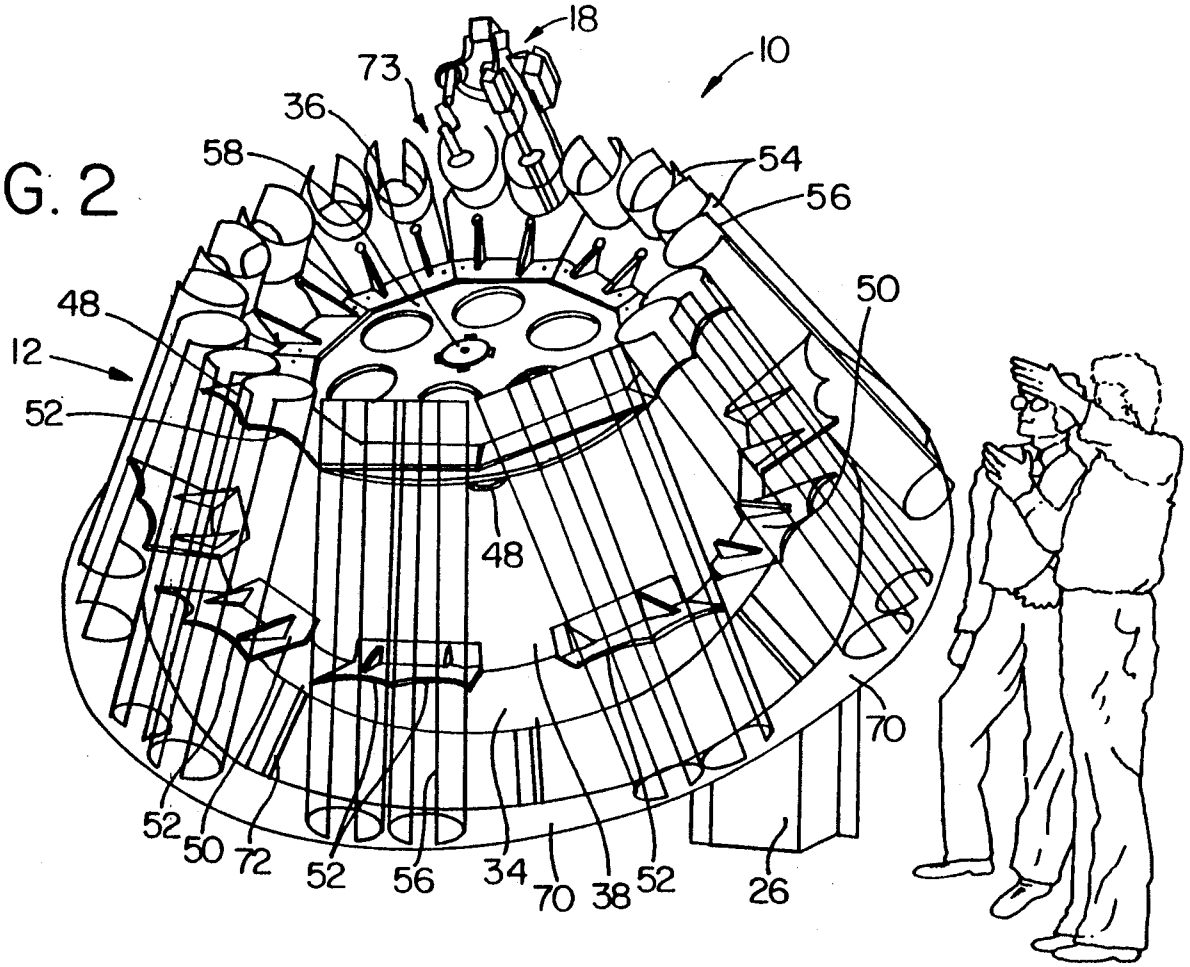
FIG. 2 is an end perspective view of the carousel assembly.
Figure 3:
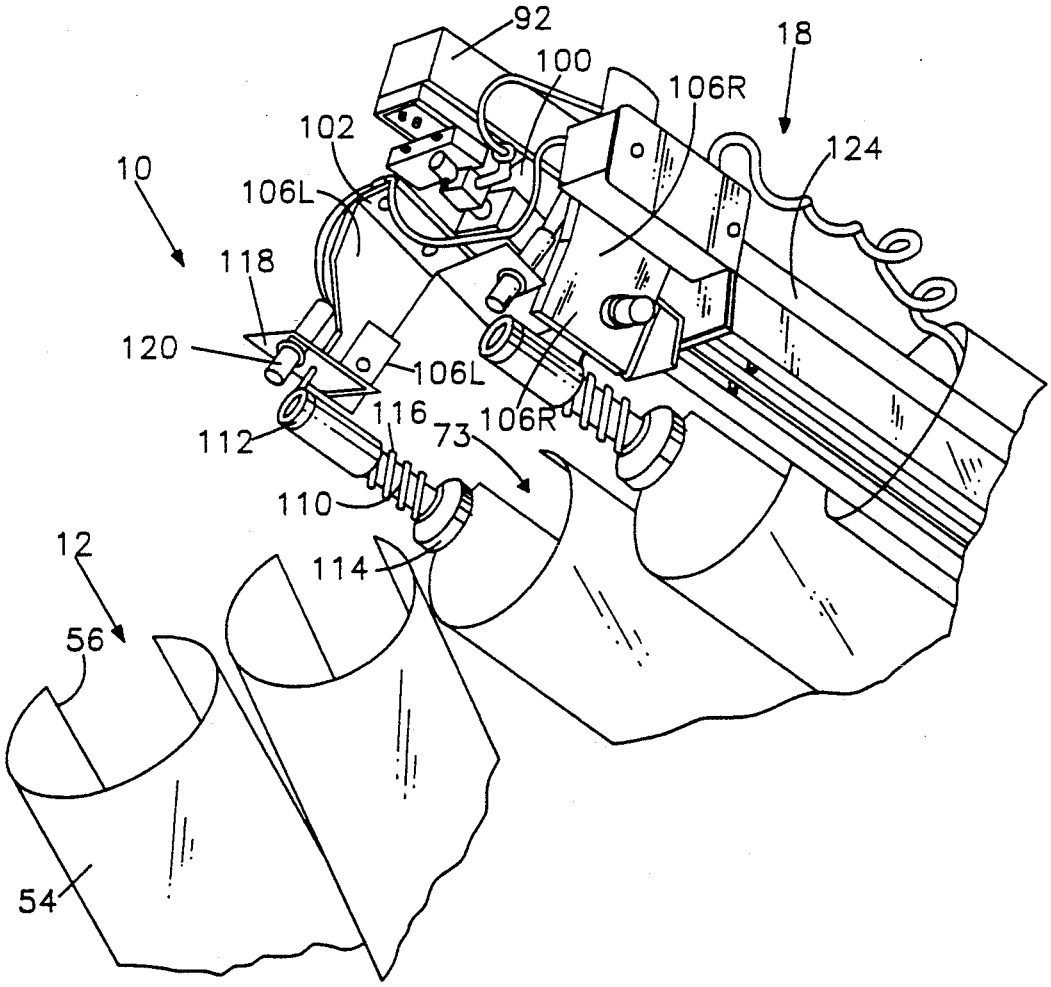
FIG. 3 is an enlarged perspective view of the upstream portion of the pusher assembly.

As shown more particularly in FIGS. 1-3, carousel assembly 12 includes a slide plate set 24 which adjustably connects carousel assembly 12 to a fixed frame 26. Specifically, slide plate set 24 includes a slide plate bracket 28 of a generally triangular shape, with one leg 28*a* thereof being connected to an angled portion 26*a* of fixed frame 26 through a slide assembly 30 of a conventional nature which permits adjustment of the position of slide plate set 24 along the direction of the front face of angled portion 26*a* of fixed frame 26. Such adjustment can be made by a hand wheel 32 of slide assembly 30. The inclined outer leg 28*b* of slide bracket 28 has a circular mounting plate 34 mounted thereon such that mounting plate 34 is oriented at an angle of approximately 35° to the horizontal, as shown in FIG. 1.

Circular mounting plate 34 is provided with a central pivot 36 mounted thereon, with a lower carousel plate 38 mounted on central pivot 36 in spaced relation to mounting plate 34. Central pivot 36 is permitted to rotate with respect to mounting plate 34 so as to also rotate lower carousel plate 38 therewith and is secured thereon by means of a bushing 40.

A plurality of tube brackets 44 are fixedly mounted along the periphery of lower carousel plate. Specifically, each tube bracket 44 includes a L-shaped bracket connection 46, an upper tube resting plate 48 connected at the upper end of L-shaped bracket connection 46, and a lower tube resting plate 50 connected to the lower end of L-shaped bracket connection 46. L-shaped bracket connections 46 are not shown in FIG. 2 for ease of understanding of the drawing. Tube resting plates 48 and 50 are each provided with two arcuate recessed sections 52 at the radially outer edge thereof, as shown best in FIG. 2 so that each tube bracket 44 is adapted to receive two transparent tubes 54 thereagainst. Tubes 54 are secured to upper and lower tube resting plates 48 and 50 by any conventional means, such as screws, bolts, or the like. It will be appreciated that, because of the angulation of tube brackets 44, transparent tubes 54 are oriented at an angle of approximately 55° with respect to the plane of lower carousel plate 38.

Each tube 54, as shown in FIG. 2, has an opening or slit 56 extending along the entire length of the outer wall thereof, with slit 56 facing in the radially outward direction, and the purpose of which will become apparent hereinafter. Preferably, tubes 54 are transparent in order to view the contents, that is, the lids 14 therein. It is further noted that tubes 54 are open at their upper and lower ends thereof.

A plurality of, for example three, roller spacer assemblies 59 are mounted at the underside of lower carousel plate 38 at the periphery thereof. Each assembly 59 includes a roller bearing 64 which rides on the upper surface of mounting plate 34.

In one embodiment, in order to support the lids 14 positioned within carousel tubes 54, a substantially annular stop plate 70 is positioned immediately below the lower ends of carousel tubes 54 in order to prevent the lids positioned therein from escaping. Stop plate 70 is fixed in surrounding relation to mounting plate 34 by a plurality of radially extending connecting portions 72, as best shown in FIG. 2. It will be appreciated, however, that stop plate 70 is open at the removal position 73 in order to permit the lids within carousel tubes thereat to be pushed out of tubes 54 by pusher assembly 18, as will be described in more detail hereinafter. In this manner, the lower ends of carousel tubes 54 and the lowermost lids 14 therein ride on and along stop plate 70.

Figure 2A:
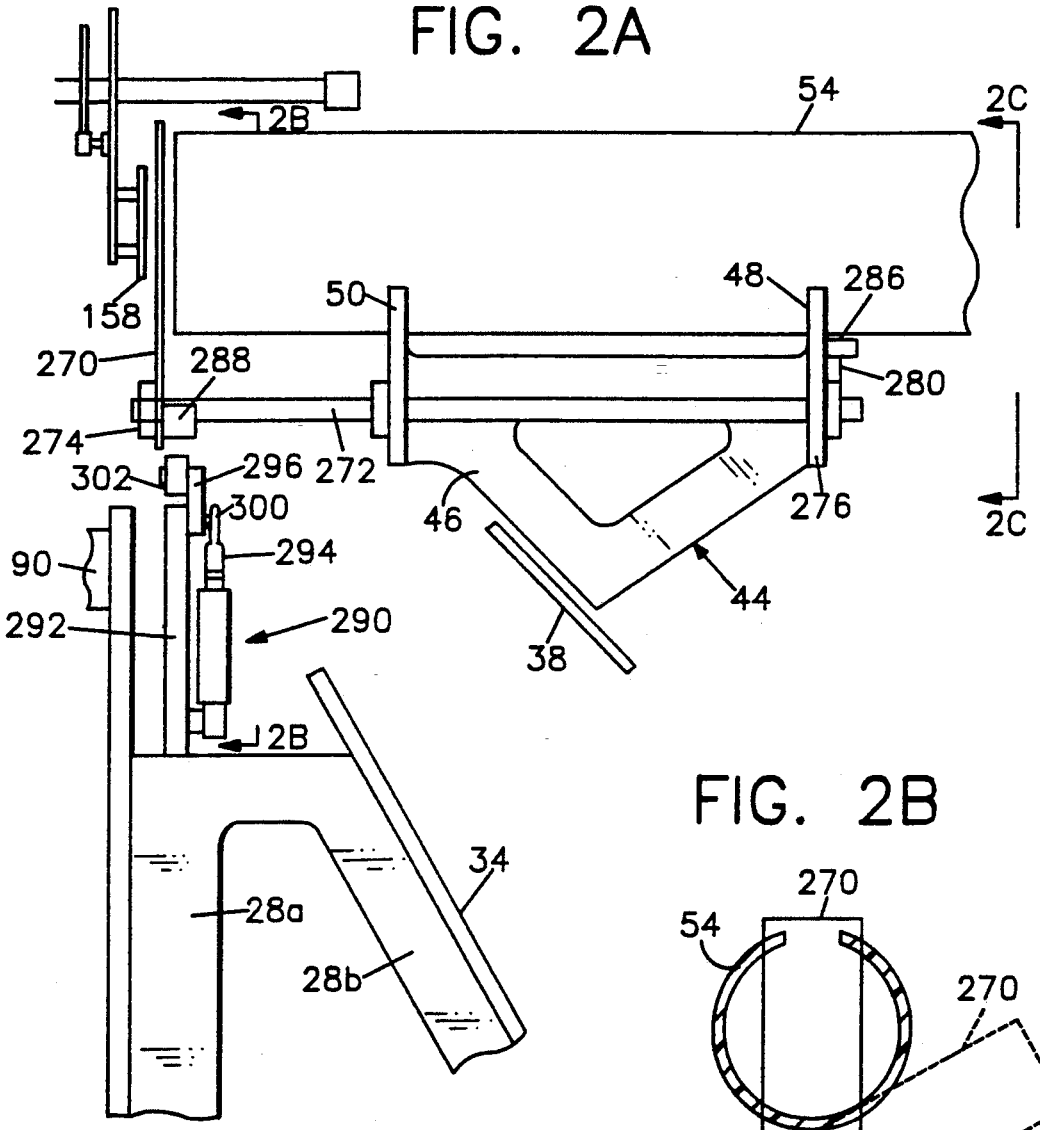
FIG. 2A is an enlarged elevational view of a portion of the assembly of FIG. 1.
Figure 2B:
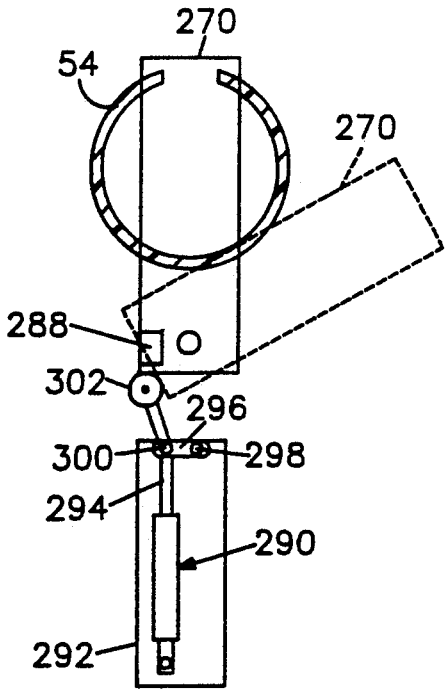
FIG. 2B is a cross-sectional view of the portion of the assembly of FIG. 2A, taken along line 2B—2B thereof.
Figure 2C:
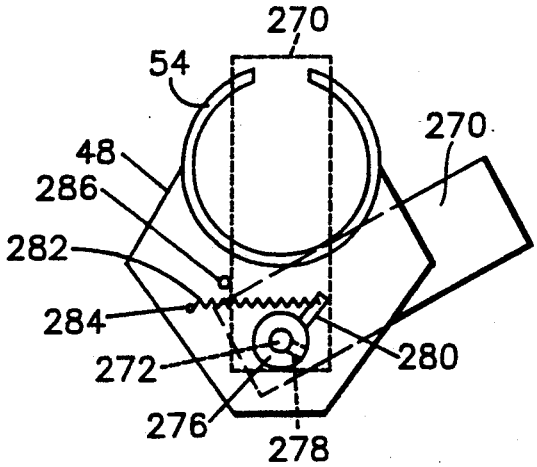
FIG. 2C is an end plan view of the portion of the assembly of FIG. 2A, viewed along line 2C—2C.

In accordance with a more preferred embodiment of the invention, as shown in FIGS. 2A-2C, in order to support the lids 14 positioned within carousel tubes 54, a substantially rectangular stop plate 270 is pivotally mounted in front of the lower end of each tube 54. Specifically, each stop plate 270 is fixed at the lower end of a pivot shaft 272 which rotatably extends through tube resting plates 48 and 50. A collar 274 is provided on one end of pivot shaft 272 in order to prevent escape of stop plate 270 therefrom. In addition, the opposite end of pivot shaft 272 extends out from tube resting plate 48 and has a collar 276 secured thereon for rotation therewith. As best shown in FIG. 2C, collar 276 is secured to pivot shaft 272 by an Allen screw 278 or the like which permits adjustment of the angular position of collar 276 on pivot shaft 272. A pin 280 extends radially outward from collar 276, and a coil spring 282 has one end connected to a hole 284 or the like in tube resting plate 48 and its opposite end connected to pin 280 in order to apply a counter-clockwise rotational force on shaft 272 and stop plate 270, as viewed in FIG. 2C. A stop post 286 is provided on tube resting plate 48 so as to limit the counter-clockwise rotation of pivot shaft 272 and stop plate 270. Specifically, pin 280, absent any external force, will be forced by coil spring 282 into contact with stop post 286, whereupon stop plate 270 will normally be positioned in blocking relation to the lower end of the respective tube 54, as shown in the dashed line position of FIG. 2C.

When a pair of tubes 54 are moved to the removal position, the respective stop plate 270 associated with each tube 54 is in the position shown in FIG. 2B in blocking relation to the lower end of the tube 54. In order to move stop plates 270 out of such blocking relation, each stop plate 270 is formed with a block 288 thereon. Accordingly, if block 288 is pushed upwardly in FIG. 2B, stop plate 270 is forced to rotate to the dashed line position of FIG. 2B. It will be appreciated that, during such pivoting motion, pivot shaft 272 also is rotated with stop plate 270, and accordingly, pin 280 is rotated therewith to the position shown in FIG. 2C.

In order to rotate each stop plate 270, a piston/cylinder arrangement 290 is fixed to the lower end of an extension plate 292 which is mounted on top of slide bracket 28. Piston/cylinder arrangement 290 includes a reciprocable piston 294 controlled for movement between a retracted condition shown in FIG. 2A and an extended position. A bent lever arm 296 has one end pivotally connected by a pivot pin 298 at the upper end of extension plate 292, and the free end of piston 294 is pivotally connected by a pivot pin 300 to the bent portion of bent lever arm 296. The opposite end of bent lever arm 296 has a roller 302 attached thereto and positioned immediately below block 288. Accordingly, when piston 294 is moved to its extended position, roller 302 hits against block 288 in order to move stop plate 270 from the solid line position of FIG. 2B to the dashed line position thereof. In such position, the lids in the respective tube 54 can be removed. When piston 294 is retracted, coil spring 282 rotates pivot shaft 272 and thereby stop plate 270 back to the solid line position of FIG. 2B.

Figure 2D:
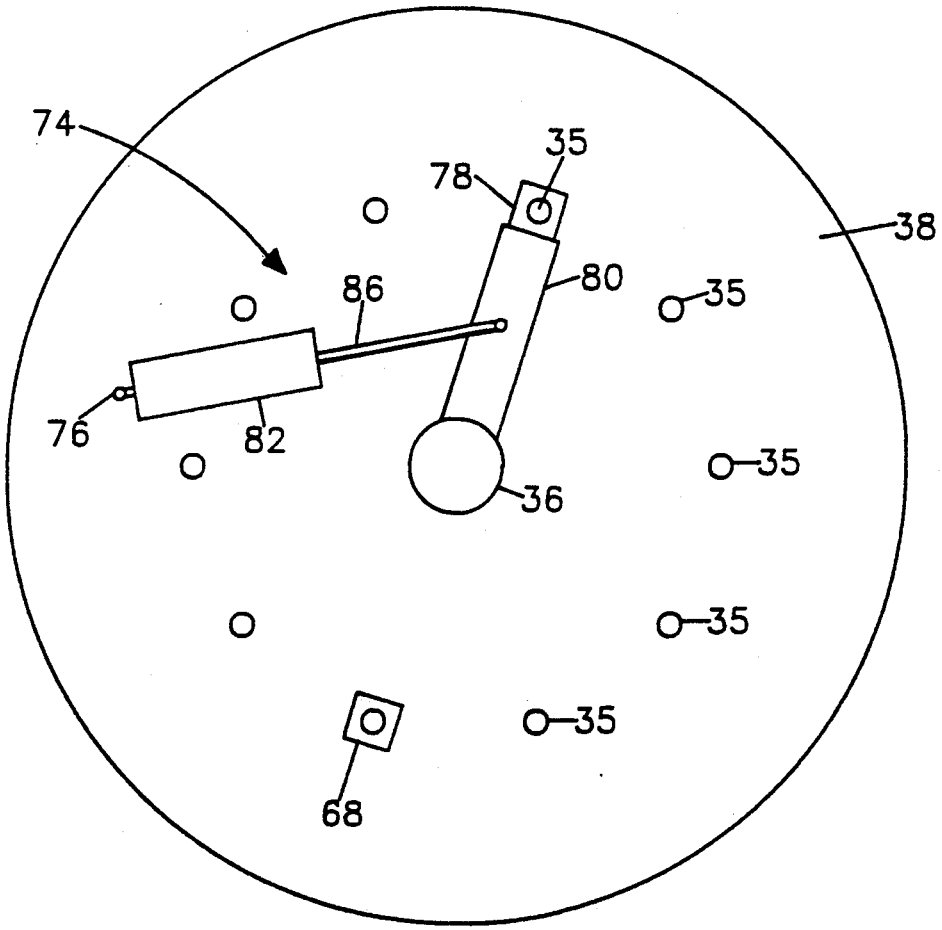
FIG. 2D is a bottom plan view of the lower carousel plate and the indexing mechanism therefor.

In order to rotate carousel assembly 12, and particularly lower carousel plate 38 thereof, as shown in FIGS. 1 and 2D, a drive assembly 74 includes an indexing arm 80 rotatably mounted about central pivot 36 and having an air cylinder 78 connected at the free end thereof. Air cylinder 78 is adapted to selectively engage the head of any of the circularly arranged screws 35 mounted to the underside of carousel plate 38. A stand-off 76 is mounted on the upper surface of mounting plate 34 and a piston/cylinder arrangement 86 has its cylinder portion pivotally connected to stand-off 76 and the free end of its piston pivotally connected to a substantially central portion of indexing arm 80. In addition, an air cylinder 68 is provided in diametrically opposite relation to air cylinder 78. Air cylinder 68 is mounted on the upper surface of mounting plate 34 and is adapted to selectively engage any of the screw heads 35.

With this arrangement, in order to index carousel plate 38, air cylinder 68 releases its respective screw head 35, while air cylinder 78 engages its respective screw head 35. Then, the piston of piston/cylinder arrangement 86 is retracted. Accordingly, carousel plate 38 is rotated an incremental distance corresponding to the angular distance between screw heads 35. Then, after retraction has been complete, air cylinder 68 engages the next screw head 35 with which it is associated and air cylinder 78 releases its respective screw head 35. The piston of piston/cylinder arrangement 86 is then extended, and the indexing operation has been completed.

Accordingly, with the invention thus described, a worker can unload one or more boxes of lids into tubes 54 of carousel assembly 12 and need only replenish the same periodically, whereupon the worker can spend his time with other tasks.

Spin rod assembly 16 is positioned downstream of carousel assembly 12, as shown in FIG. 1. Spin rod assembly 16 includes two or three parallel, spaced spin rods 90 rotatably mounted to frame 26 at an angle of approximately 20° with respect to the horizontal, with the higher ends of spin rods 90 being adjacent carousel assembly 12. The manner of rotatably mounting and rotating spin rods 90 does not form part of the present invention and is well known in the art. Suffice it to say that spin rods 90 are rotated by motors (not shown) in a known manner, at a speed to cause a stack of lids thereon to move downwardly towards the lower end thereof. In this regard, since there are three spin rods, two stacks of lids 14 are placed in parallel relation on the spin rods, that is, with one stack of lids sitting on and between the center spin rod and one outside spin rod and the other stack of lids 14 sitting on and between the center spin rod and the other outside spin rod.

Vacuum pick and place assembly 20 is positioned at the lower ends of spin rods 90 and includes four pairs of arms having vacuum suction cups thereon for removing the lowermost lids, one at a time, from both stacks of lids 14 on spin rods 90, and by rotation of vacuum pick and place assembly 20, depositing the removed lids for further processing. Vacuum pick and place assembly 20, along with subsequent downstream assemblies, do not form part of the present invention and are of a conventional nature. Therefore, these assemblies will not be further discussed herein.

The essence of the present invention resides in the combination of carousel assembly 12 with pusher assembly 18, which slightly compresses, but mostly guides the stacks of lids in tubes 54 at the removal position and pushes the slightly compressed stacks onto spin rods 90.

Specifically, pusher assembly 18 includes a fixed frame member 92 positioned above and parallel to spin rods 90, and extending above carousel tubes 54 at the removal position of carousel assembly 12, as best shown in FIG. 1. Frame member 92 has lower guide tracks 92*b* on opposite sides thereof. As shown best in FIGS. 1 and 4, a rodless air cylinder 93 includes a conventional stationary rod 94 fixed to the underside of frame member 92 and spaced therefrom by opposite bracket assemblies 96 and 98, respectively. A yoke 100 of rodless air cylinder 93 is received on stationary rod 94. In other words, yoke 100 is adapted to ride along stationary rod 94. Yoke 100 is conventional and is adapted to move back and forth along stationary rod 94, as in a conventional rodless air cylinder. A mounting plate 102 is secured on top of rodless air cylinder 100, and four rotatable guide wheels 104 are mounted on the upper surface of mounting plate 102, two guide wheels 104 engaging one guide track 92*b* and the other two guide wheels 104 engaging the other guide track 92*b* for riding therealong so as to support yoke 100 on stationary rod 94 and to prevent rotation of yoke 100 about stationary rod 94.

Figure 4:
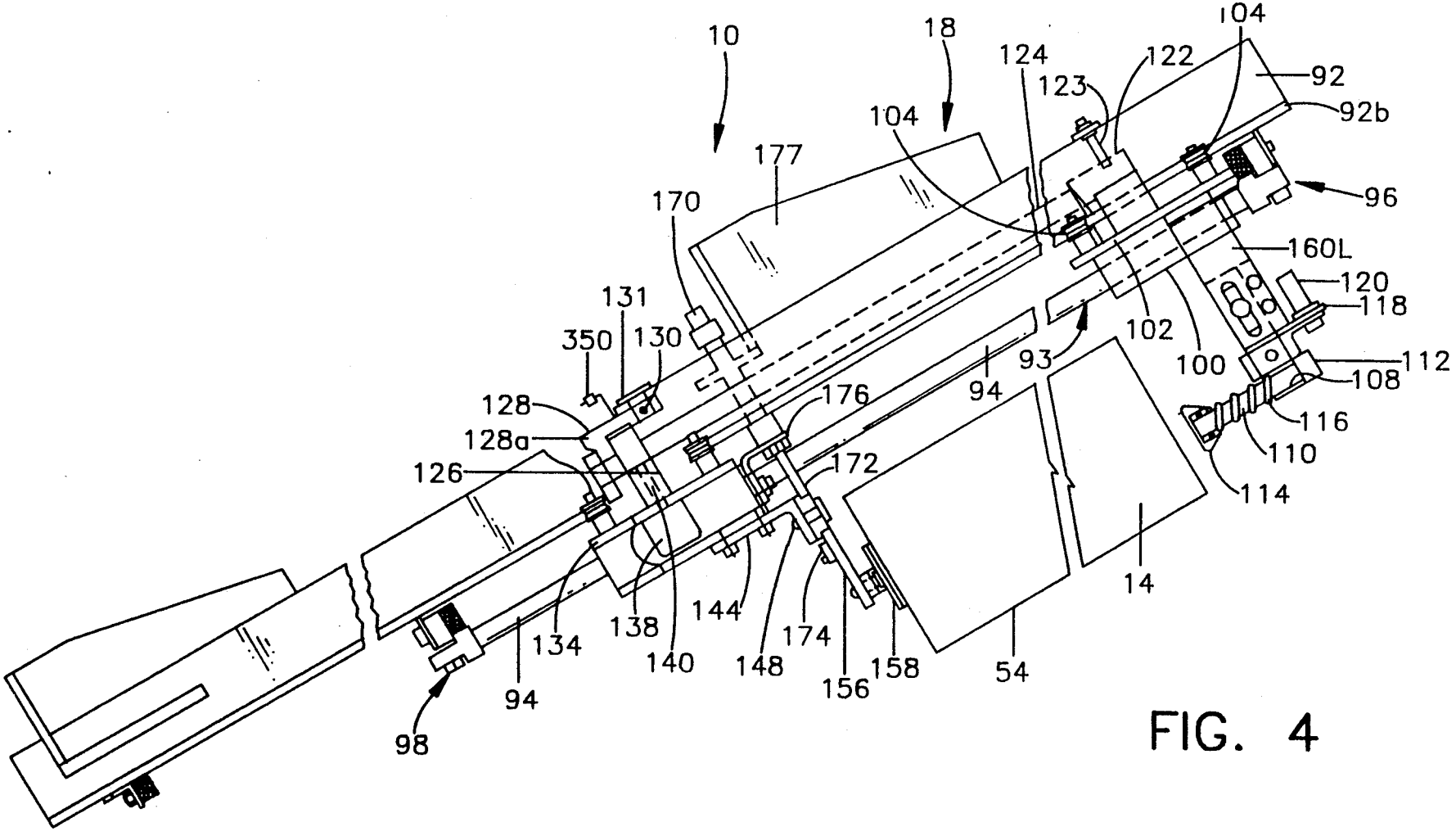
FIG. 4 is a side elevational view, partly broken away, of the pusher assembly.
Figure 5:
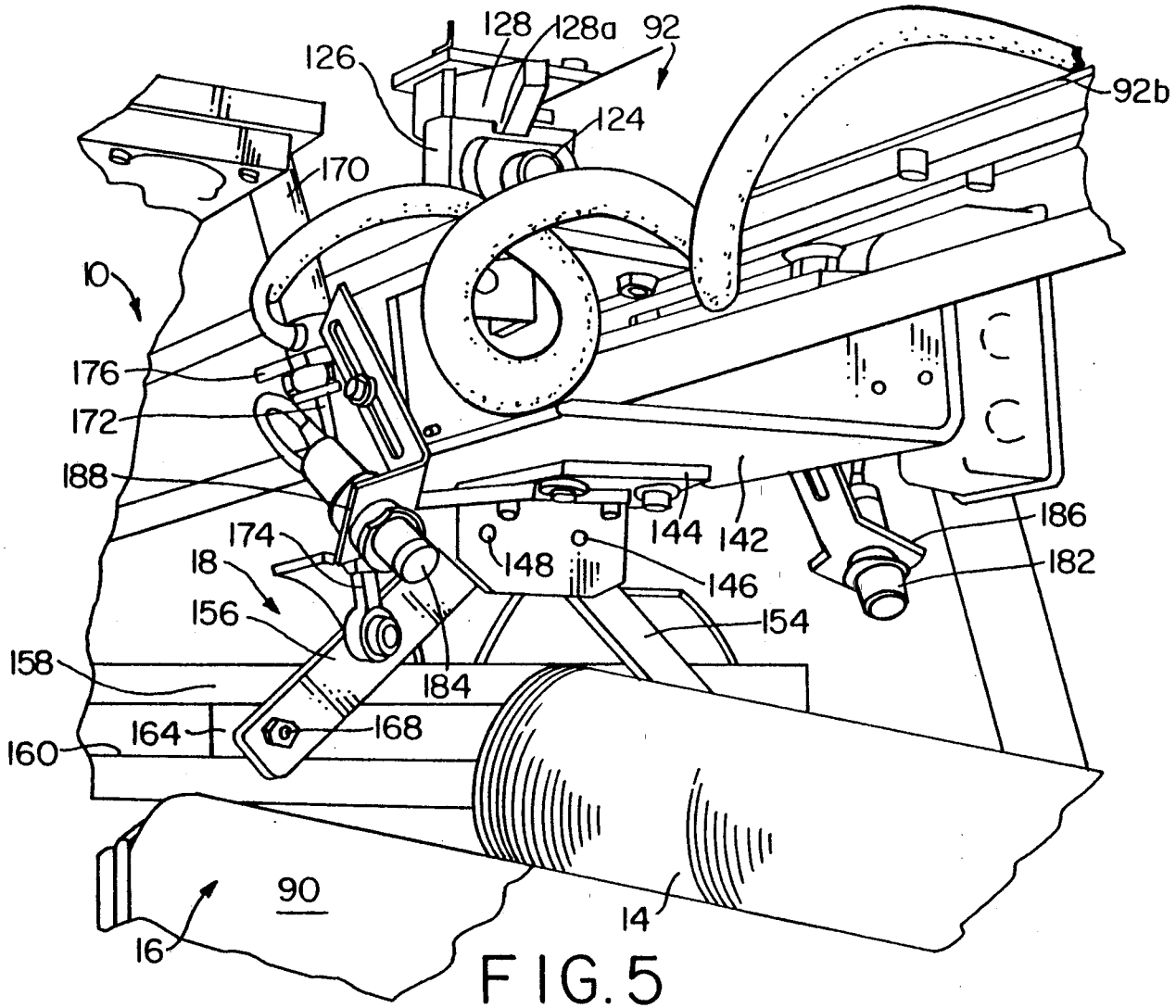
FIG. 5 is a perspective view of the downstream end of the pusher assembly of FIG. 4.

In accordance with the present invention, a left pusher bracket 106L and a right pusher bracket 106R are secured to mounting plate 102 and hang down therefrom on opposite sides of yoke 100. The lower end of each pusher bracket 106L and 106R includes a through bore 108 which receives a pusher shaft 110 therethrough. A retaining ring 112 is fixed to the rear end of each pusher shaft 110 and a pusher head 114 is secured to the opposite end of each pusher shaft 110 so as to prevent escape of pusher shaft 110 from through bore 108. In addition, a coil spring 116 is wrapped around pusher shaft 110 between the respective pusher bracket 106L or 106R, and its pusher head 114, so as to normally bias pusher head 114 away from the pusher bracket. In this regard, as shown in FIGS. 3 and 4, retaining ring 112 abuts against the respective pusher bracket to define the position of pusher shaft 110 and pusher head 114. It will be appreciated, as shown in FIGS. 3 and 4, that pusher heads 114 are positioned rearwardly of the upper open ends of the two carousel tubes 54 at the removal position. It will further be appreciated that the reason for slits 56 in carousel tubes 54 is to permit pusher brackets 106L and 106R to travel through carousel tubes 54 in order to enable pusher head 114 to enter into and engage lids 14 within carousel tubes 54.

In addition, a sensor bracket 118 is mounted to each pusher bracket 106L and 106R immediately above pusher shafts 110, each sensor bracket 118 carrying an optical sensor 120. Optical sensor 120 shines a light immediately behind the respective retaining ring 112 when the latter is in the position shown in FIGS. 3 and 4. When yoke 100 travels down along stationary rod 94, pusher head 114, which moves along therewith, pushes against the rearwardmost lid 14 in the respective carousel tube 54. As a result, as will be discussed in more detail hereinafter, pusher shaft 110 is moved rearwardly, so that the respective retaining ring 112 blocks the optical path of optical sensor 120.

A mounting block 122 is also mounted on top of mounting plate 102 to one side of frame member 92 and a movable rod 124 has one end fixed to mounting block 122 for movement therewith. Movable rod 124 extends adjacent and parallel to frame member 92.

The opposite end of movable rod 124 is slidably mounted in a securement block 126. Securement block 126 is mounted on a carriage 134, with four guide wheels 136 mounted on carriage 134 so as to engage guide tracks 92b of frame member 92 in the same manner as guide wheels 104. The guide wheels 136 are only shown on one side of FIG. 6 for the sake of simplicity in the drawing. A short stroke-type cylinder 138 (not shown in FIG. 6) is mounted to the underside of carriage 134 immediately below securement block 126 and includes a piston rod 140 which extends through a bore in securement block 126 which is in communication with the bore that receives movable rod 124. In the position shown in FIG. 6, piston rod 140 is in its retracted position. However, when piston rod 140 is in its extended position, it extends into engagement with movable rod 124 to lock movable rod 124 to securement block 126.

Figure 6:
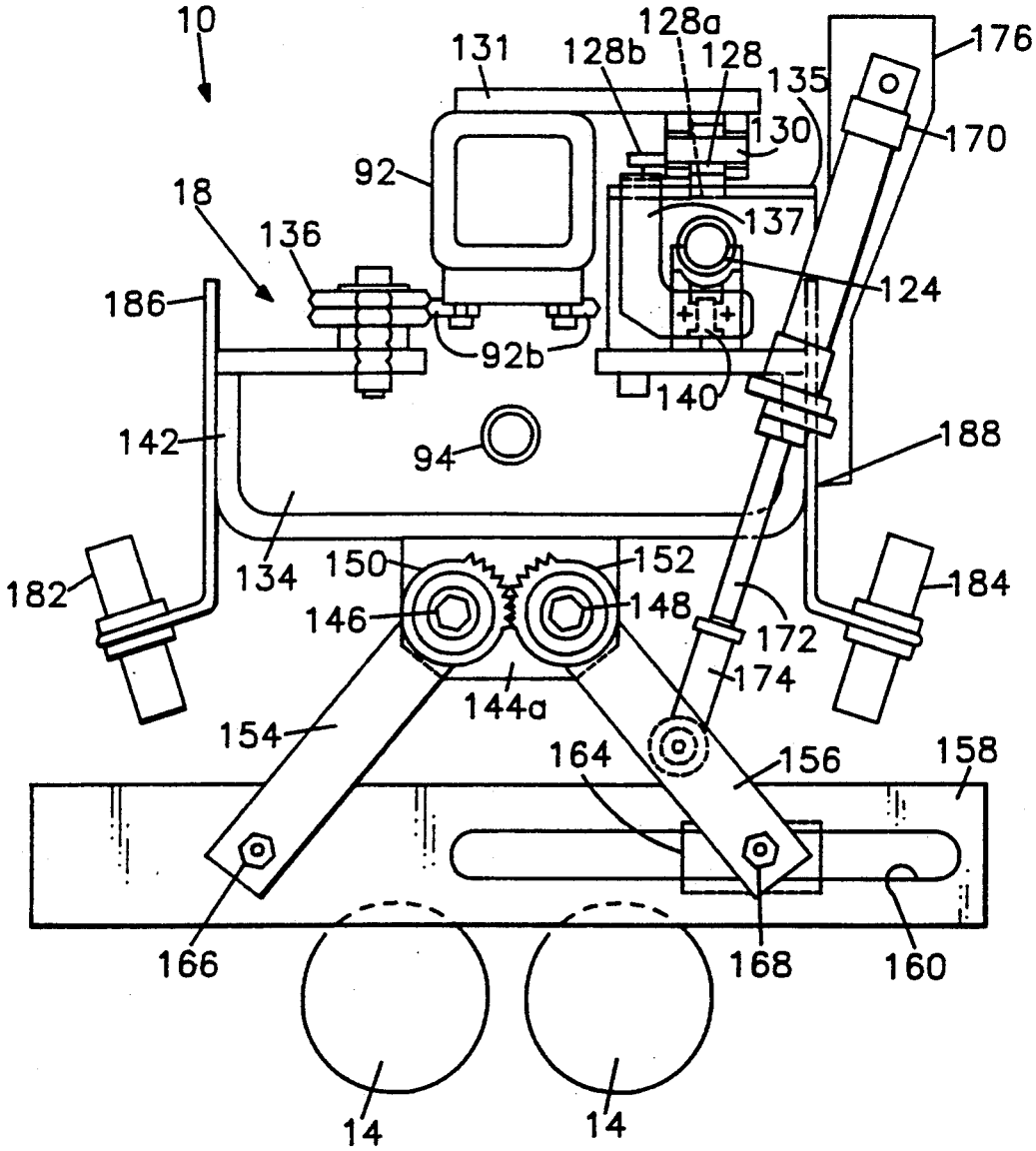
FIG. 6 is an elevational view of the downstream end of the pusher assembly.

A tie bar holder 135, as shown best in FIG. 6, is mounted on carriage 134. A latch 128 is pivotally mounted by a pivot pin 130 to a bracket 131 mounted on top of frame member 92. In the position shown in FIGS. 4 and 6, the free end of latch 128 is formed with a latch hook 128a which engages tie bar holder 135. Latch 128 further includes a release bar 128b secured thereto. To disengage latch hook 128a from tie bar holder 135, a lift bar 137 is mounted for movement with piston rod 140. Therefore, when piston rod 140 is moved to its extended position, lift bar 137 engages extension 128b so as to disengage latch hook 128a from tie bar holder 135.

An angle bracket 144 is mounted to the underside of housing 142 and extends rearwardly therefrom. As best shown in FIGS. 4, 6 and 7, two parallel, adjacent pivot pins 146 and 148 are mounted to the downwardly hanging leg 144a of angle bracket 144. A gear 150 is rotatably mounted on pivot pin 146 and a gear 152 is rotatably mounted on pivot pin 148, with gears 150 and 152 being in meshing engagement. The rear faces of gears 150 and 152 are fixed to lift arms 154 and 156, respectively. A mounting bar 158 is secured to the lower ends of lift arms 154 and 156. Specifically, mounting bar 158 has a generally rectangular configuration with a central lengthwise rectangular slot 160 at one side therein. Slide block 164 is positioned on the opposite side of mounting bar 158 from the free end of lever arm 156, and connected thereto by means of a pivot screw 168 extending through slot 160. The free end of lever arm 154 is pivotally connected to the opposite end of mounting bar 158. Accordingly, when lift arms 154 and 156 are rotated upwardly in FIG. 6, mounting bar 158 is moved upwardly therewith.

In order to move lift arms 154 and 156 upwardly, a double acting type cylinder 170 has its piston rod 172 connected to a midpoint of lift arm 156 by means of an eye-type rod 174. Cylinder 170 is pivotally supported by a cylinder pivot holder 176 that is mounted, as shown in FIG. 6, to carriage 134.

Upon actuation of cylinder 170, piston rod 172 is retracted, thereby pivoting lift arm 156 in the counter clockwise direction of FIG. 6 about pivot pin 148. Because gears 150 and 152 are in meshing engagement and fixed to lift arms 154 and 156, this also results in pivoting of lift arm 154 about pivot pin 146 in the clockwise direction of FIG. 6. As a result, the free ends of lift arms 154 and 156 move upwardly in FIG. 6. Because the free end of lift arm 156 is slidably retained within slot 160 by slide block 164, slide block 164 moves outwardly of slot 160, thereby resulting in the raising of mounting bar 158 such that the lower level thereof is above the uppermost point of the lowermost lid 14 in carousel tubes 54 at the removal position.

In addition, optical sensors 182 and 184 are mounted by brackets 186 and 188, respectively, to opposite sides of carriage 134, and are positioned so as to point rearwardly of mounting bar 158.

Further, two optical sensors 190 are positioned on opposite sides of frame member 92 at a position immediately above the two stacks of lids on spin rods 90.

In operation, optical sensors 190 determine whether a minimum stack of lids are present in each tube 54 at the removal position. If not, piston/cylinder arrangement 74, along with air cylinders 68 and 78 are actuated to incrementally rotate carousel plate 38 until sensors 190 determine that a pair of tubes 54 contain a minimum stack of lids therein. Then, when the last or rearmost lids 14 on spin rods 90 pass optical sensors 190, optical sensors 190 detect a dark area, as opposed to the previously detected white areas of the lids. As a result, optical sensors 190 supply a signal to piston/cylinder arrangement 290 in order to pivot stop plates 270 at the removal position out of the way, as shown by the solid line in FIG. 2C. Optical sensors 190 also supply signals to rodless air cylinder 93 to cause movement of yoke 100 from the position shown in FIG. 4 downwardly along stationary rod 94. Pusher heads 114 therefore enter carousel tubes 54 at the removal position and engage the rearmost lids 14 of the stacks of lids in the two carousel tubes 54. The leading or forwardmost lid of each stack of lids is, at this time, in engagement with mounting bar 158, since stop plates 270 have been moved out of the way.

At this time, piston rod 140 of cylinder 138 is in its retracted position, and latch 128 is engaged with tie bar holder 135. Accordingly, securement block 126, carriage 134, lift arms 154 and 156 and mounting bar 158 remain in a fixed position. Since piston rod 140 is in its retracted position, movable bar 124, which is fixed to mounting block 122 and moves therewith, is able to move through securement block 126 during movement of yoke 100 of rodless air cylinder 93.

Yoke 100 continues to move forwardly from the position shown in FIG. 4 until pusher heads 114 engage and only slightly compress the stacks of lids 14 in carousel tubes 54 at the removal position between pusher heads 114 and mounting bar 158. During continued movement of yoke 100, pusher shafts 110 are forced rearwardly against the force of the weak or soft coil springs 116, thereby compressing the same. During this movement, retaining rings 112 are moved into blocking relation of the optical path of optical sensors 120. At this time, optical sensors 120 send a signal to brake yoke 100 of rodless air cylinder 93 by means of equalizing pressure. At the same time, sensors 120 send a signal to cylinder 138 in order to extend piston rod 140 into engagement with movable rod 124, so as to lock movable rod 124 to securement block 126. This, of course, results in lift arm 137 releasing pivot latch 128 out of engagement with tie bar holder 135. Accordingly, pusher heads 114 and mounting bar 158 are fixed in position with respect to each other so as to maintain the stacks of lids 14 in the very slightly compressed position. When optical sensor 350 (FIG. 4) detects latch 128 to be disengaged, it sends a signal for continued movement of rodless air cylinder 100 along stationary rod 94. As a result, the two stacks of lids from carousel tubes 54 at the removal position are carried between mounting bar 158 and pusher heads 114 out of carousel tubes 54, to a position on spin rods 90.

When optical sensors 182 and 184 detect the rearwardmost lids already on spin rods 90, the forwardmost lids 14 from the carousel tubes 54 are in close proximity thereto. At this time, optical sensors 182 and 184 send a signal to brake yoke 100 and to actuate double acting cylinder 170 in order to retract piston rod 172 and move mounting bar 158 upwardly out of the way of lids 14. As a result, the two stacks of lids from carousel tubes 54 are provided on spin rods 90 with a small gap between the leading lid of such stacks and the rearwardmost lids of the stacks already on the spin rods. Spin rods 90 cause the two stacks to merge.

At the same time, yoke 100 of rodless air cylinder 93 is controlled to move rearwardly to the position of FIG. 4 when optical sensor 190 senses mounting bar 158. As it approaches this position, mounting bar 158 clears the rearwardmost lid of the stack of lids from carousel tubes 54 which have been placed on spin rods 90 and is lowered. Optical sensor 123 also detects the return of yoke 100 of rodless air cylinder 93 and supplies a signal to cylinder 138 to control it to retract piston rod 140 away from movable rod 124. Further, the mechanical assembly of latch 128 once again rides over and latches tie bar holder 135. In addition, a signal is sent to carousel assembly 112, and particularly air cylinder 82 of drive assembly 74 thereof, to rotate lower carousel plate 38 a predetermined amount to place a new pair of carousel tubes 54 containing lids 14 therein at the removal position. Then, when sensor 190 again detects depletion of lids 14 on spin rods 90, the operation is repeated.

It will be appreciated that, with the present invention, it is not necessary for a worker to continuously run back and forth to replenish the lids on the spin rods as in known apparatus. Rather, with the present arrangement, a worker can unload one or more boxes of lids into the carousel feeder and need only replenish the same periodically, whereupon the worker can spend his time with other tasks.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined by the appended claims.

What is claimed is:

1. A lid loading and conveying assembly comprising:

carousel means for holding a plurality of stacks of lids;

rotatable support means for rotationally supporting said carousel means so that said stacks of lids can be sequentially moved to a removal position;

track means for holding a stack of said lids removed from said carousel means;

sensor means for sensing when the amount of lids on said track means is below a predetermined level; and pusher means for pushing a stack of lids axially from said carousel means at said removal position to said track means in response to said sensor means, said pusher means including constrainment means at opposite ends of said stack of lids for holding said stack of lids together as a unit in a slightly compressed form during the pushing operation from said carousel means to said track means.

2. A lid loading and conveying assembly according to claim 1, wherein said carousel means includes a carousel plate rotationally mounted on said rotatable support means, and a plurality of tubes means mounted on said carousel plate for holding a plurality of stacks of lids, with each tube means holding one said stack of lids therein.

3. A lid loading and conveying assembly according to claim 2, wherein said plurality of tube means includes a plurality of carousel tubes mounted along a periphery of said carousel plate.

4. A lid loading and conveying assembly according to claim 3, wherein said carousel tubes are grouped in pairs, with said pairs of carousel tubes being equiangularly spaced around said carousel plate.

5. A lid loading and conveying assembly according to claim 3, wherein each said tube includes a slit extending along the entire length thereof and facing in a radially outward direction.

6. A lid loading and conveying assembly according to claim 3, wherein said carousel plate is oriented at an angle to ground level, and said carousel tubes are oriented at an angle to said carousel plate such that said carousel tubes at said removal position are substantially parallel to said track means.

7. A lid loading end conveying assembly according to claim 3, further including blocking means for removably blocking a lower end of each said tube.

8. A lid loading and conveying assembly according to claim 7, wherein said blocking means includes a pivot plate pivotally mounted in front of the lower end of each said tube, and pivot means for pivoting each pivot plate out of said blocking arrangement at the removal position.

9. A lid loading and conveying assembly according to claim 2, further including a second carousel plate arranged in substantially parallel, spaced relation above the first-mentioned carousel plate and said tube means being connected therewith for providing at least two positions of attachment of said tube means.

10. A lid loading and conveying assembly according to claim 2, wherein said rotatable support means includes a mounting plate positioned in substantially parallel spaced relation below said carousel plate, pivot means for pivotally mounting said carousel plate in a substantially parallel spaced relation from said mounting plate, and drive means connected between said mounting plate and said carousel plate for incrementally rotating said carousel plate with respect to said mounting plate.

11. A lid loading and conveying assembly according to claim 10, further including an annular stop plate mounted about said mounting plate and connected thereto, said stop plate being positioned immediately below lower ends of said tube means, and said stop plate being cut away to provide an opening at said removal position.

12. A lid loading and conveying assembly according to claim 1, wherein said track means includes a plurality of substantially parallel rotatable spin rods, with two adjacent spin rods defining a track for a stack of said lids.

13. A lid loading and conveying assembly according to claim 1, wherein said sensor means includes an optical sensor which produces an output signal when a rearwardmost lid of a stack of lids on said track means passes thereby.

14. A lid loading and conveying assembly according to claim 1, wherein said pusher means includes a fixed frame positioned above said carousel means and said track means, said constrainment means includes mounting bar means for holding one end of a stack of lids from said tube means at said removal position and upstream pushing means for holding the opposite end of said stack of lids from said tube means such that said stack of lids is held as a unit in a slightly compressed form between said mounting bar means and said upstream pushing means, and said pusher means further includes moving means for moving said mounting bar means and said upstream pushing means together along said fixed frame in order to convey said slightly compressed stack of lids as a unit onto said track means.

15. A lid loading and conveying assembly according to claim 14, wherein said fixed frame includes a stationary rod, and said moving means includes drive means for moving along said stationary rod, said drive means being connected with said upstream pushing means and removably connected with said mounting bar means.

16. A lid loading and conveying assembly according to claim 15, wherein said moving means includes a rodless air cylinder movable along said stationary rod, said upstream pushing means being directly connected to said rodless air cylinder, and removable connection means for removably connecting said mounting bar means with said rodless air cylinder.

17. A lid loading and conveying assembly according to claim 16, wherein said upstream pushing means includes a pusher bracket fixedly mounted with respect to said rodless air cylinder, said pusher bracket including a through bore positioned immediately behind the rearwardmost lid of the stack of lids in said carousel means at said removal position, a pusher shaft slidably mounted through said bore and including a collar at one end of said pusher shaft and a pusher head at the opposite end of said pusher shaft so as to prevent removal of said pusher shaft from said through bore, and spring means for biasing said pusher head away from said pusher bracket.

18. A lid loading and conveying assembly according to claim 17, wherein said pusher means further includes sensor means for sensing sliding movement of said pusher shaft against the force of said spring means.

19. A lid loading and conveying assembly according to claim 18, wherein said removable connection means includes a movable bar having one end fixedly connected with respect to said rodless air cylinder and movable therewith, a securement block having a through bore for slidably receiving an opposite end of said movable bar therethrough, latch means for preventing movement of said securement block in at least a first direction with respect to said frame, solenoid means for releasably securing said securement block to the opposite end of said movable bar, and means for connecting said securement block to said mounting bar means.

20. A lid loading and conveying assembly according to claim 19, wherein said latch means includes a latch hook for engaging said securement block and actuator means for moving said latch hook out of engagement with said securement block in response to said sensor.

21. A lid loading and conveying assembly according to claim 19, wherein said means for connecting includes at least one lift arm pivotally connected to said housing means, said mounting bar means is mounted to a free end of said at least one lift arm, and further including pivoting means for pivoting said at least one lift arm in order to raise and lower said mounting bar.

22. A lid loading and conveying assembly according to claim 21, wherein there are two said lift arms, each pivotally attached to said housing means about a pivot point and said mounting bar is mounted between the free ends of said two lift arms.

23. A lid loading and conveying assembly according to claim 22, wherein said mounting bar includes a lengthwise slot therein and further including sliding blocks for connecting said free ends adjacent said slot so as to provide sliding movement thereof with respect to said slot, whereby pivotal movement of said lift arms results in raising and lowering of said mounting bar.

24. A lid loading and conveying assembly according to claim 21, wherein said mounting bar means includes a first gear fixed to one said lift arm about the pivot point thereof and a second gear fixed to the second lift arm about the pivot point thereof, said first and second gears being in meshing engagement, and said pivoting means includes piston-cylinder means for pivoting one of said lift arms about the pivot point thereof, said piston-cylinder means including piston means connected with said one lift arm.

* * * * *